US006223477B1

(12) United States Patent
Alley

(10) Patent No.: US 6,223,477 B1
(45) Date of Patent: May 1, 2001

(54) DEVICE TO SECURE SNOW GUARD TO ROOF USING A WEDGE

(76) Inventor: F. William Alley, Gebbie Rd., Greensboro, VT (US) 05841

( * ) Notice: Subject to any disclaimer, the term of this patent is extended or adjusted under 35 U.S.C. 154(b) by 0 days.

(21) Appl. No.: 09/291,673

(22) Filed: Apr. 14, 1999

(51) Int. Cl.[7] ..... E04D 13/10

(52) U.S. Cl. ..... 52/24; 52/25; 52/42; 52/44; 256/12.5

(58) Field of Search ..... 52/25, 24, 26, 52/545, 42, 44; 256/12.5

(56) References Cited

U.S. PATENT DOCUMENTS

| | | | | |
|---|---|---|---|---|
| 5,228,248 | * | 7/1993 | Haddock | 52/25 |
| 5,483,772 | * | 1/1996 | Haddock | 52/25 |
| 5,491,931 | * | 2/1996 | Haddock | 52/545 |
| 5,609,326 | * | 3/1997 | Stearns et al. | 256/12.5 |
| 5,694,721 | * | 12/1997 | Haddock | 52/24 |
| 5,715,640 | * | 2/1998 | Haddock | 52/545 |
| 5,983,588 | * | 11/1999 | Haddock | 52/545 |

* cited by examiner

*Primary Examiner*—Christopher T. Kent
*Assistant Examiner*—Jennifer I. Thissell
(74) *Attorney, Agent, or Firm*—Clifford L. Tager

(57) ABSTRACT

The present invention comprises a block having a first and a second exterior side wall, a base and a top. A groove is located in the base of the block, the groove defining a first and a second interior side wall and a top interior surface. The block is locatable on a metal roof by placement of the groove about a segment of the seam formed by overlapping adjacent roofing panels. A hole is located in the block between the top of the block and the groove, and a locking device is locatable in the hole. Initially locating the locking device into the hole causes the locking device to be positioned between a portion of the seam of the metal roof and a portion of the first interior side wall of the block. Further translocation of the locking device into the hole causes the locking device to engage the portion of the seam of the metal roof and the portion of the first interior side wall of the block, thereby securing the block to the metal roof. The further translocation of the locking device into the hole also causes the portion of the seam of the metal roof to incline towards the second interior side wall. Thus, the present invention preferably further comprises a cavity located along a portion of the second interior side wall of the block to accommodate the portion of the seam of the metal roof inclined theretowards.

41 Claims, 5 Drawing Sheets

DEVICE TO SECURE SNOW GUARD TO ROOF USING A WEDGE

BACKGROUND OF THE INVENTION

1. Technical Field

The present invention is directed to a device capable of being secured to a roof. More particularly, the present invention is directed to a device capable of being secured to a roof using a wedge.

The present invention finds particular utility in securing a snow guard to a roof.

2. Background Information

It is often desirable to secure a snow guard to a roof to prevent the snow and ice which accumulates on the roof from falling off, thereby potentially damaging persons and/or property located in the fall path of the snow and ice.

Roofs are well known in the art and include, for example, metal roofs, shingle roofs and membrane roofs. Roofs typically comprise an outer layer, such as metal panels, shingles or a rubber membrane, attached to a substrate layer, such as plywood or particle board.

In a metal roof, the outer layer typical comprises a plurality of metal panels, each running the length of the roof. The panels are laid side by side to cover the width of the roof, and the abutting panels are typically crimped together to form a water-resistant seam. Snow guards are typically attached to a metal roof by placing the snow guard over a portion of the seam and securing the snow guard to the seam, e.g., via set screws.

In a shingle roof, the outer layer typical comprises multiple rows of shingles placed in ascending fashion on the substrate layer, optionally with a layer of tar paper therebetween. Snow guards are typically attached to a shingled roof by placing same on the outer layer of the shingles and driving screws through the snow guard into the substrate layer of the roof.

In a membrane roof, the outer layer typical comprises a rubber membrane which covers the substrate layer of the roof. Snow guards are typically attached to a membrane roof by securing a base of the snow guard to the substrate layer via screws, placing the membrane over the substrate layer and base of the snow guard, removing a portion of the membrane so that a portion of the base is exposed therethrough, and then securing an upper portion of the snow guard to the exposed portion of the base.

SUMMARY OF THE INVENTION

The device of the present invention is capable of securing a snow guard to a metal roof having a first roofing panel and a second roofing panel, the first and second roofing panels each having a substantially perpendicular longitudinal edge, the longitudinal edge of the first roofing panel being positioned in close proximity to the longitudinal edge of the second roofing panel and forming a seam therealong.

In the preferred embodiment, the device of the present invention comprises a block having a first and a second exterior side wall, a base and a top. The snow guard is capable of being attached to the block. A groove is located in the base of the block, the groove defining a first and a second interior side wall and a top interior surface. The block is locatable on the metal roof by placement of the groove about a segment of the seam.

A hole is preferably located in the block between the top of the block and the groove, and a locking device is locatable in the hole. Initially locating the locking device into the hole causes the locking device to be positioned between a portion of the seam of the metal roof and a portion of the first interior side wall of the block. Further translocation of the locking device into the hole causes the locking device to engage the portion of the seam of the metal roof and the portion of the first interior side wall of the block, thereby securing the block to the metal roof.

The further translocation of the locking device into the hole also causes the portion of the seam of the metal roof to incline towards the second interior side wall. Thus, the present invention preferably further comprises a cavity located along a portion of the second interior side wall of the block to accommodate the portion of the seam of the metal roof inclined theretowards.

The locking device is preferably tapered along its longitudinal axis, such as a conical structure or a wedge-shaped structure, and can either comprise a rigid material or a compressible material.

In an alternative embodiment, the hole is located on the side of the block, between one of the exterior side walls of the block and the groove. Initially locating the locking device into the side hole causes the locking device to be positioned between a portion of the seam of the metal roof and the top interior surface of the block. Further translocation of locking device into the side hole causes the portion of the seam of the metal roof to be compressed towards the base of the block, causing the locking device to be secured in the resulting compression, thereby preventing longitudinal movement of the block along the seam of the roof.

To prevent the upward movement of the block, relative to the roofing panels, filler blocks are preferably located within the groove, secured to the interior side walls of the block.

In another preferred embodiment, the device of the present invention comprises a mounting bracket having a first and a second plate. The first plate has a base and a top, and the base of the first plate is capable of being secured to the roof. The second plate has a first and a second edge, with the first edge being securely attached to the top of the first plate and substantially perpendicular thereto.

The device also comprises a block having a first and a second exterior side wall, a base and a top. The snow guard is capable of being attached to the block. A groove is located in the base of the block, the groove defining a first and second interior side wall and a top interior surface. The block is locatable on the roof by placement of the groove about the second plate of the mounting bracket.

A hole is preferably located in the block between the top of the block and the groove, and a locking device is locatable in the hole. Initially locating the locking device into the hole causes the locking device to be positioned between a portion of the second plate of the mounting bracket and a portion of the first interior side wall of the block. Further translocation of the locking device into the hole causes the locking device to be secured between the portion of the second plate of the mounting bracket and the portion of the first interior side wall of the block, thereby securing the block to the mounting bracket.

In an alternative embodiment, the hole is located on the side of the block, between the first exterior side wall of the block and the groove. Additionally, a first cavity is located along the second edge of the second plate of the mounting bracket.

Initially locating the locking device into the side hole causes the locking device to be in juxtaposition with a portion of the top interior surface of the block and located within the first cavity of the second plate of the mounting bracket, thereby preventing longitudinal movement of the block along the mounting bracket.

A second cavity is preferably located within a portion of the second interior side wall of the block to accommodate a portion of the locking device.

To prevent the upward movement of the block, relative to the mounting bracket, the mounting bracket preferably further comprises a third plate having a base and a top, the base of the third plate being securely attached to the second edge of the second plate. Additionally, a filler block is preferably secured to an interior side wall of the block below the hole. The filler block and third plate of the mounting bracket are preferably positioned to prevent the vertical movement of the block, relative to the roofing panels.

In lieu of the filler block, the groove is wider near the top interior surface of the block, relative to the width of the groove near the base of the block. The block is locatable on the mounting bracket by sliding the block over a terminal end of the second and third plate of the mounting bracket.

DESCRIPTION OF THE PREFERRED EMBODIMENT(S)

The present invention can be attached to any type of roof, including but not limited to a metal roof, a shingle roof, a tar roof or a membrane roof. A roof typically comprises an outer layer, such as metal panels, shingles, a layer of tar or a rubber membrane. The outer layer is typically attached to a substrate layer, such as plywood or particle board.

Figure 1:
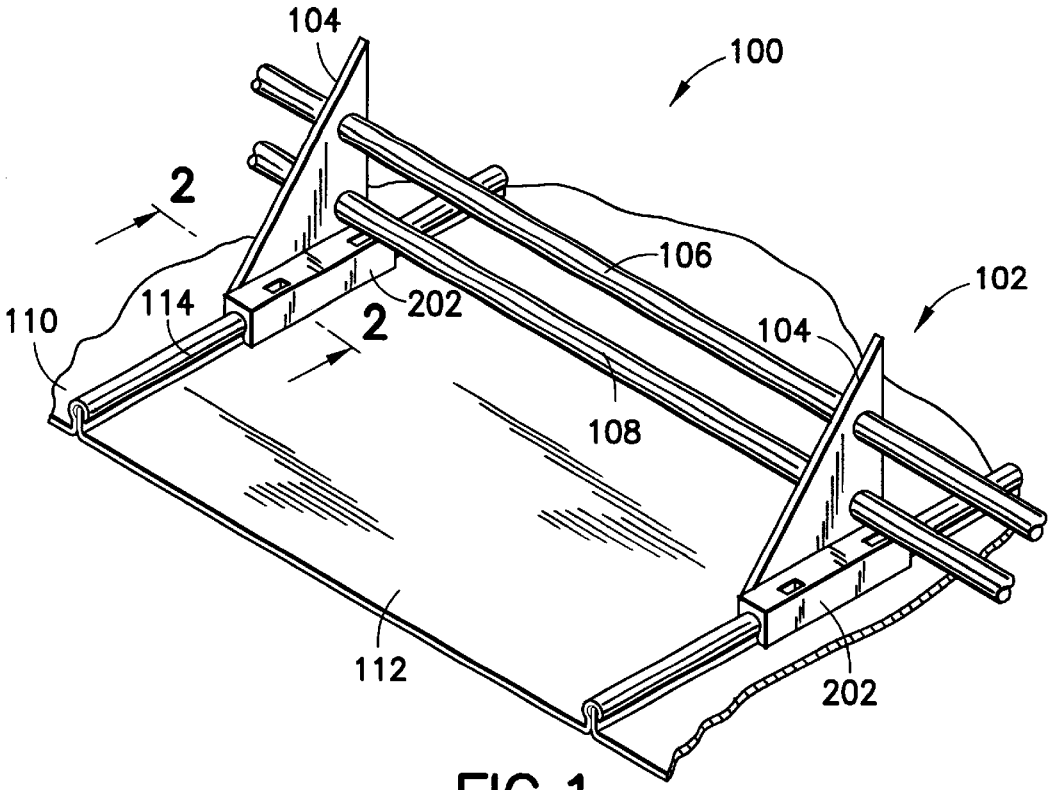
FIG. 1 is an isometric view of the preferred embodiment of the present invention, shown with a snow guard attached to a roof.

Turning now to FIG. 1, the present invention 100 is shown attached to a metal roof having metal panels 110 and 112 co-joined at seam 114 with snow guard 102 attached thereto.

Snow guard 102 preferably comprises a plurality of brackets 104, each having holes located therein to allow pipes 106 and 108 to be placed therethrough. The pipes act as a fence to help prevent ice and/or snow from falling off the roof and potentially damaging persons and property located in its fall path.

Each bracket 104 is preferably attached to the side of block 202, and pipes 106 and 108 are preferably secured within brackets 104 of the snow guard via set screws, as described in detail with reference to U.S. Pat. No. 5,613,328 to Alley, incorporated herein by reference.

Variations to the configuration of the snow guard, such as the number of pipes, shape of the brackets, method of securing the pipes within the brackets, method of attaching the brackets to the block and placement of the bracket with respect to the block, will be obvious to those skilled in the art.

While the present invention is described hereinbelow as having a snow guard attached thereto, it is to be understood that other items could be attached to the roof via the present invention, either in addition to or in place of the snow guard, such as a mechanism to secure a sign, scaffolding, or other device to the roof, as will be obvious to those skilled in the art.

Additionally, while the present invention is described hereinbelow as being attached to a roof, it is to be understood that the present invention can be attached to any other structure having a seam-like projection, regardless of the relative angle of the projection.

Figure 2:
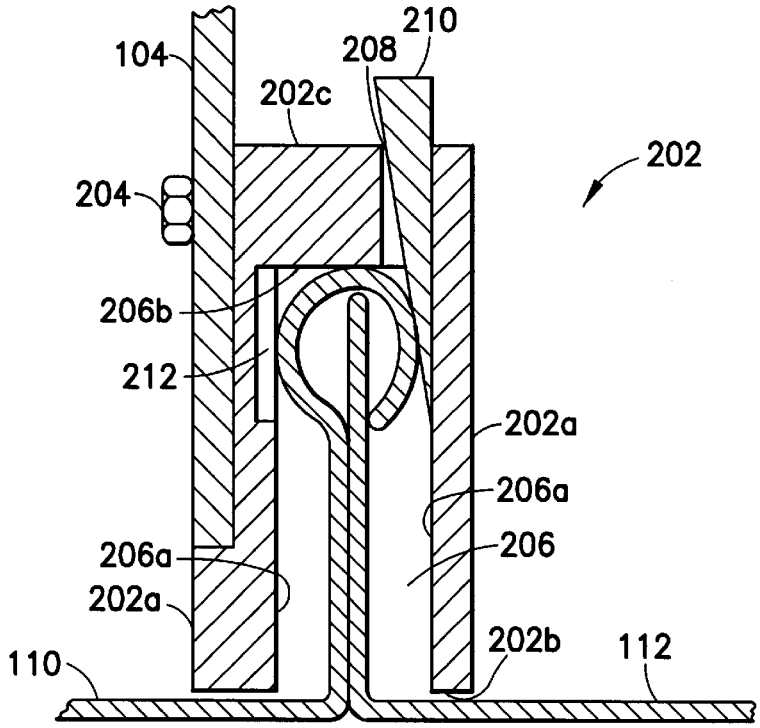
FIG. 2 is a cross-sectional view of the preferred embodiment of the present invention shown in FIG. 1.

Turning now to FIG. 2, a cross-sectional view of block 202, taken at section lines 2—2 of FIG. 1, is illustrated.

Block 202 has exterior side walls 202*a*, base 202*b* and top 202*c*, and is shown having bracket 104 of the snow guard attached to one of the exterior side walls 202*a* via threaded bolt 204. Alternatively, brackets 104 can be attached to the top of block 202, as described in detail with reference to U.S. Pat. No. 5,613,328 to Alley.

Groove 206 is preferably located in the base of block 202, the groove defining interior side walls 206*a* and top interior surface 206*b* of sufficient dimension to allow the block to be located about a segment of seam 114 (FIG. 1).

Hole 208 is preferably located in block 202 between top 202*c* of the block and groove 206, of sufficient dimension to allow locking device 210 to be located therein.

In use, initially locating locking device 210 into hole 208 causes the locking device to be positioned between a portion of the seam of the metal roof and a portion of one of the interior side walls 206*a* of the block. Further translocation of locking device 210 into hole 208 causes the locking device to engage the portion of the seam of the metal roof and the portion of the interior side wall of the block, thereby securing the block to the metal roof such that block 202 is effectively precluded from sliding along the seam of the metal roof.

Where the seam of the metal roof, formed by the overlapping of metal panels 110 and 112, is relatively compact, the further translocation of locking device 210 into hole 208 causes the portion of the seam in contact with the locking device to be bent towards the interior side wall opposite the locking device.

Thus, in the preferred embodiment, block 202 further comprising cavity 212 located along the interior side wall of the block, substantially opposite the location of the locking device, to accommodate the portion of the seam of the metal roof inclined theretowards. The bending of the seam into cavity 212 also helps prevent the upward movement of the block, relative to the surface of the metal roof.

A cavity (not shown) may also be located along the interior side wall of the block in juxtaposition with the location of the locking device to accommodate a portion of the locking device therein.

Figure 3:
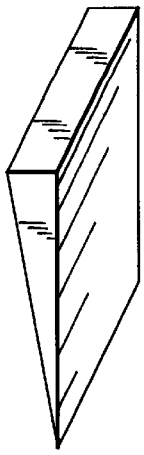
FIG. 3 is an isometric view of an embodiment of a wedge.
Figure 4:
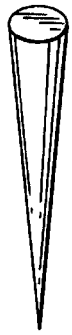
FIG. 4 is an isometric view of an alternative embodiment of the wedge shown in FIG. 3.

In the preferred embodiment, locking device 210 is tapered along its longitudinal axis, for example, as a wedge-shaped structure, as shown with reference to FIG. 3, or as a conical structure, as shown with reference to FIG. 4. The taper allows the locking device to gradually contact and bend the seam of the metal roof, thereby minimizing any tearing which may otherwise occur at the seam from a non-tapered locking device.

In the preferred embodiment, the locking device comprises a rigid material, such as metal or plastic. Alternatively, the locking device comprises a compressible material, such as a rubber compound, thereby providing a higher coefficient of friction, relative to a rigid material such as metal.

Figure 5:
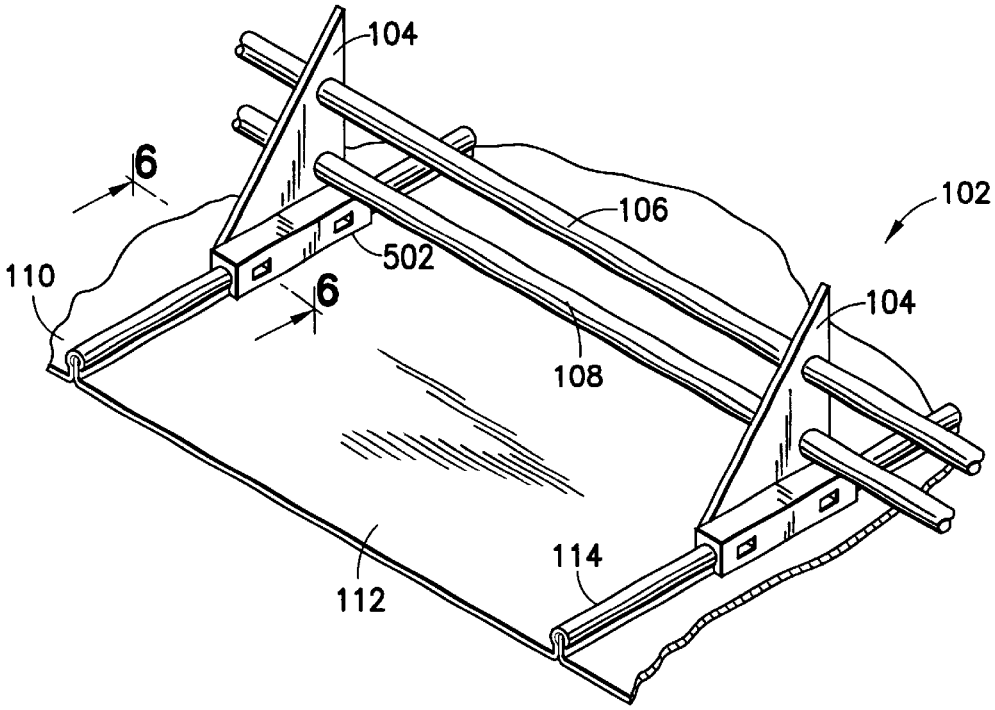
FIG. 5 is an isometric view of an alternative embodiment of the present invention, shown with a snow guard attached to a roof.

Turning now to FIG. 5, an isometric view of an alternative embodiment of the present invention is shown attached to a metal roof having metal panels 110 and 112 co-joined at seam 114 with snow guard 102 attached thereto.

Snow guard 102 preferably comprises a plurality of brackets 104, each having holes located therein to allow pipes 106 and 108 to be placed therethrough. Each bracket 104 is preferably attached to block 502, thereby securing the snow guard to the roof.

Figure 6:
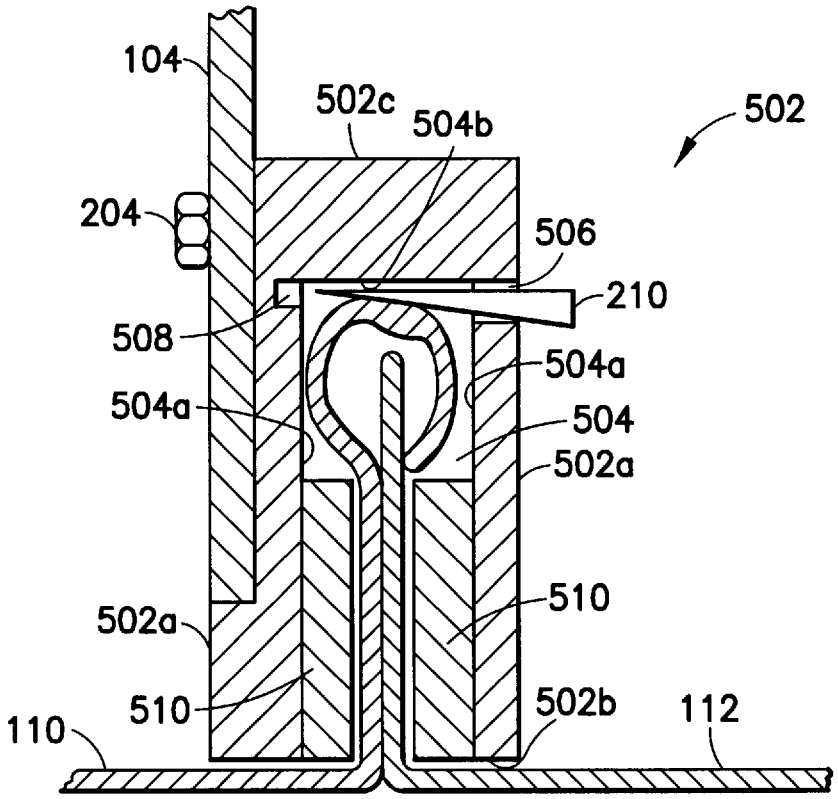
FIG. 6 is a cross-sectional view of the embodiment of the present invention shown in FIG. 5.

Turning now to FIG. 6, a cross-sectional view of block 502, taken at section lines 6—6 of FIG. 5, is illustrated.

Block 502 has exterior side walls 502*a,* base 502*b* and top exterior surface 502*c,* and is shown having bracket 104 of the snow guard attached to one of the exterior side walls 502*a* via threaded bolt 204. Alternatively, brackets 104 can be attached to the top of block 502, as described in detail with reference to U.S. Pat. No. 5,613,328 to Alley.

Groove 504 is preferably located in the base of block 502, the groove defining interior side walls 504*a* and top interior surface 504*b* of sufficient dimension to allow the block to be located about a segment of seam 114 (FIG. 5).

Hole 506 is preferably located in block 502 between one of the exterior side walls 502*a* of the block and groove 504, and is of sufficient dimension to allow locking device 210 to be located therein.

In use, initially locating locking device 210 into hole 506 causes the locking device to be positioned between a portion of the seam of the metal roof and top interior surface 504*b* of the block. Further translocation of locking device 210 into hole 506 causes the portion of the seam of the metal roof to be compressed towards base 502*b* of the block, causing the locking device to be secured in the resulting compression, thereby preventing longitudinal movement of block 502 along the seam of the roof.

Where the dimensions of locking device 210 are such that it is possible for the terminal end of the locking device to contact the interior side wall opposite hole 506, cavity 508 is preferably located within interior side wall 504*a* of the block to accommodate the terminal end of the locking device should same be fully inserted into hole 506.

Another cavity (not shown) may optionally be located along top interior surface 504*b* of the block, in juxtaposition with the location of the locking device, to accommodate a portion of the locking device therein.

To prevent the upward movement of block 502, relative to roofing panels 110 and 112, filler blocks 510 are preferably located within groove 504, and secured to interior side walls 504*a* of block 502 via screws (not shown) or other suitable securing mechanism. Other types and/or shapes of filler blocks can be employed, e.g., as described in detail with reference to U.S. Pat. No. 5,732,513 to Alley.

Alternatively, filler blocks 510 can be contiguous with and form a part of interior side walls 504*a* of block 502 by machining groove 504 such that the groove is wider near top interior surface 504*b* and narrower therebelow. In this case, the block would be located on the seam of the metal roof by sliding the block over a terminal end of the seam.

Figure 7:
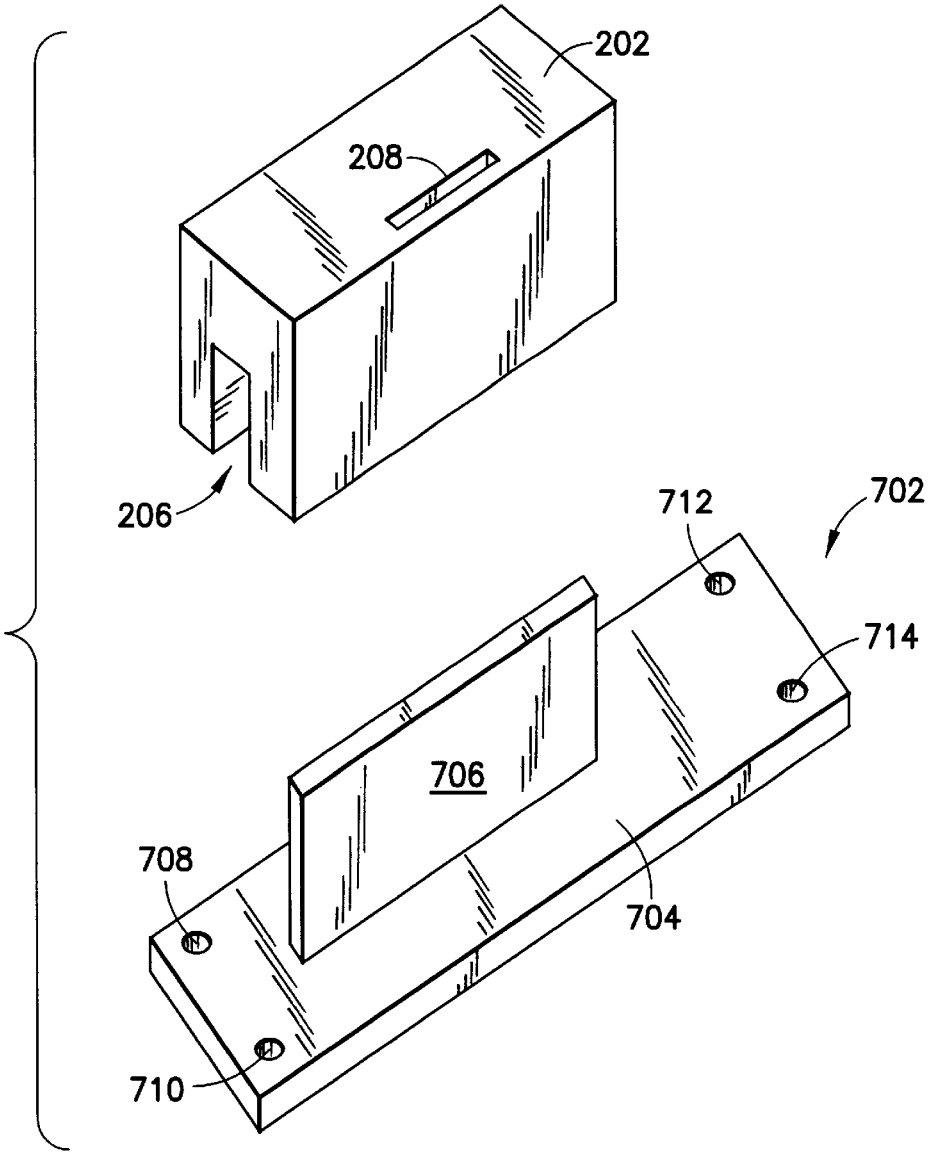
FIG. 7 is an isolated exploded isometric view of an alternative embodiment of the block shown in FIG. 1, together with a mounting bracket therefor.

Turning now to FIG. 7, an alternative embodiment of the present invention is illustrated. Specifically, an exploded isometric view of block 202, together with mounting bracket 702, is shown.

In the preferred embodiment, block 202 is locatable on mounting bracket 702, which comprises plate 704 and plate 706 mounted substantially perpendicular thereto. Plates 704 and 706 can be secured together by weld or other conventional method. In the preferred embodiment, plate 704 is integral with plate 706 and cast as a single unit therewith.

As discussed above with reference to FIG. 2, groove 206 is preferably located in the base of block 202, the groove defining interior side walls and a top interior surface of sufficient dimension to allow the block to be located about plate 706 of the mounting bracket.

Hole 208 is preferably located in block 202 between the top of the block and groove 206, and is of sufficient dimension to allow the locking device (not shown) to be located therein.

In use, plate 704 of the mounting bracket is attached to the outer surface of a roof via screws (not shown) located through holes 708–714. Block 202 is located on mounting bracket 702 via placement of groove 206 about plate 706, and the locking device is driven into hole 208.

Initially locating locking device 210 into hole 208 preferably causes the locking device to be positioned between a portion of plate 706 of the mounting bracket and a portion of one of the interior side walls of the block. Further translocation of locking device 210 into hole 208 preferably causes the locking device to be secured between plate 706 and the interior side wall of the block, thereby securing the block to the mounting bracket.

It is to be understood that the mounting bracket can be secured to any surface, whether horizontal or otherwise, interior or exterior, to provide a location at which to secure block 202. In this way, devices other than snow guards may be secured to the block.

Plate 706 and/or the interior side wall of the block can optionally include a cavity (not shown) located along a portion thereof to accommodate a portion of the locking device.

Figure 8:
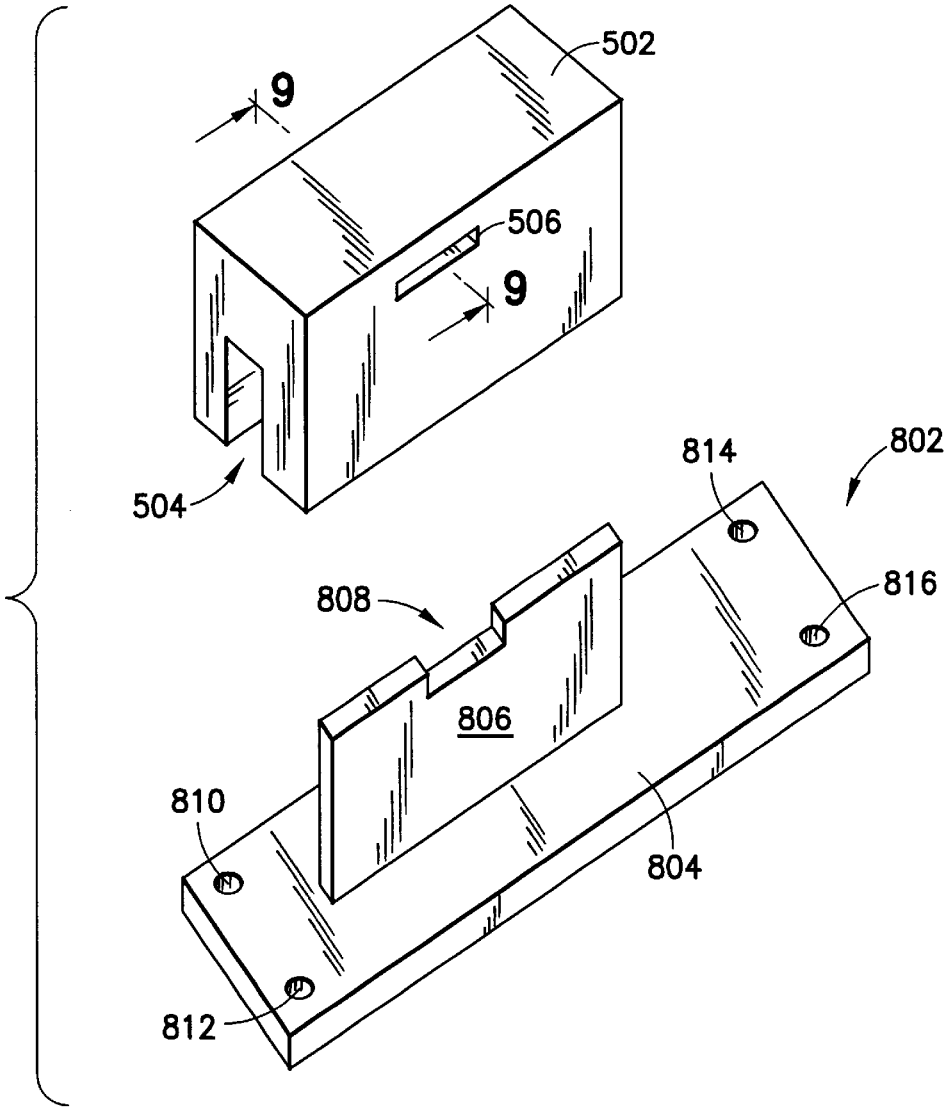
FIG. 8 is an isolated exploded isometric view of an alternative embodiment of the block shown in FIG. 5, together with a mounting bracket therefor.

Turning now to FIG. 8, another alternative embodiment of the present invention is illustrated. Specifically, an exploded isometric view of block 502, together with mounting bracket 802, is shown.

In the preferred embodiment, block 502 is locatable on mounting bracket 802, which comprises plate 804 and plate 806 mounted substantially perpendicular thereto, with cavity 808 located along the edge of plate 806.

As discussed above with reference to FIG. 6, groove 504 is preferably located in the base of block 502, the groove defining interior side walls and a top interior surface of sufficient dimension to allow the block to be located about plate 806 of the mounting bracket.

Hole 506 is preferably located in block 502 between one of the exterior side walls of the block and groove 504, and is of sufficient dimension to allow the locking device to be located therein.

In use, plate 804 of the mounting bracket is attached to the outer surface of a roof via screws (not shown) located through holes 810–816. Block 502 is located on mounting bracket 802 via placement of groove 504 about plate 806, and the locking device is driven into hole 506.

Initially locating the locking device into hole 506 preferably causes the locking device to be positioned within cavity 808 of plate 806 of the mounting bracket and in juxtaposition with a portion of the top interior surface of the block. Further translocation of the locking device into hole 506 causes the locking device to be driven into a cavity (508, FIG. 9) located within the opposite interior side wall of the block, thereby preventing longitudinal movement of the block, relative to the mounting bracket.

Figure 9:
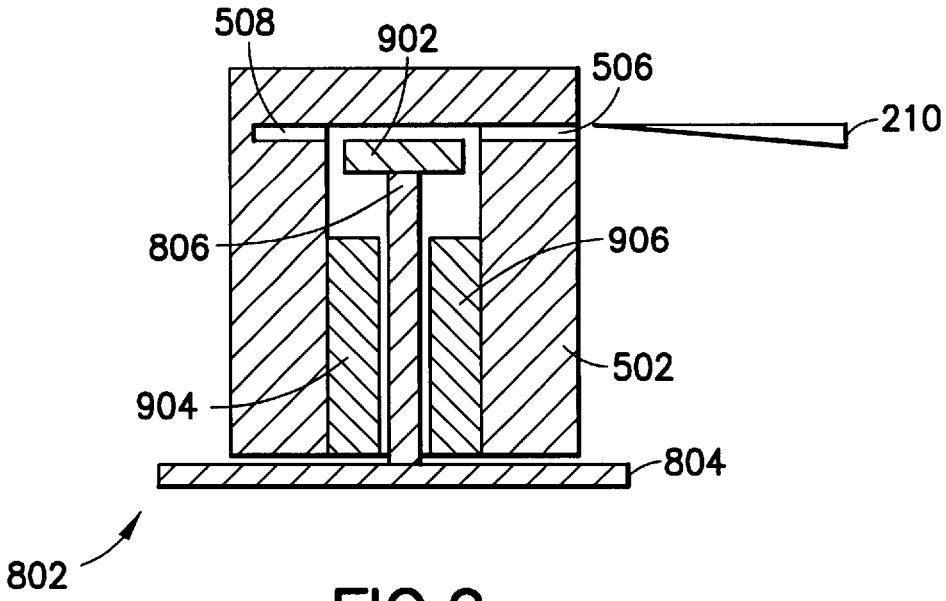
FIG. 9 is a cross-sectional view of the alternative embodiment of the present invention shown in FIG. 8.

To prevent the upward movement of block 502, relative to mounting bracket 802, reference is directed to FIG. 9, which shows a cross-sectional view of the block and mounting bracket arrangement of FIG. 8, taken at section lines 9—9.

Mounting bracket 802 preferably further comprises third plate 902 mounted to the edge of second plate 806. Additionally, filler blocks 904 and 906 are preferably located within the groove, and secured to the interior side walls of block 502 via screws (not shown) or other suitable securing mechanism.

The addition of plate 902 and filler blocks 904 and 906 prevent the upward movement of block 502, relative to mounting bracket 802.

Alternatively, filler blocks 904 and 906 can be contiguous with and form a part of the interior side walls of block 502 by machining the groove such that the groove is wider near the top interior surface of the block and narrower therebelow. In this case, the block would be located on the mounting bracket by sliding the block over the terminal end of plate 806 and 902.

In the preferred embodiment, the length of plate 902 substantially equals the length of plate 806, thereby running along the entire length thereof, including over cavity 808. Alternatively, the length of plate 902 can be substantially equal to and be located on plate 806 from one edge of cavity 808 to the nearest end of plate 806, in either or both directions, thereby keeping cavity 808 uncovered by plate 902.

As discussed with reference to FIG. 6, where the dimensions of locking device 210 are such that it is possible for the terminal end of the locking device to contact the interior side wall opposite hole 506, cavity 508 is preferably located within the interior side wall of the block to accommodate the terminal end of the locking device should same be fully inserted into hole 506.

As shown in FIGS. 7 (and 8), the length of block 202 (502) is approximately the length of plate 706 (806), with the length of plate 704 (804) substantially larger. However, it is to be understood that the lengths of plate 706 (806) and block 202 (502) can be equal to, less than or greater than the length of plate 704 (804).

In the embodiments discussed hereinabove, aluminum is the preferred material. Alternatively, steel, high-impact plastic or other suitable material or composition could be employed. Additionally, it is to be understood that all dimensions are approximate, and that other dimensions could be employed.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What I claim as my invention is:

1. A device capable of securing a snow guard to a metal roof having a first roofing panel and a second roofing panel, the first and second roofing panels each having a substantially perpendicular longitudinal edge thereon, the longitudinal edge of the first roofing panel positioned in close proximity to the longitudinal edge of the second roofing panel forming a seam therealong, the seam having a top edge, a first side edge and a second side edge, the device comprising:

a block having a first and a second exterior side wall, a base and a top, wherein the snow guard is capable of being attached to the block;

a groove located in the base of the block, the groove defining a first and a second interior side wall, wherein the block is locatable on the metal roof by placement of the groove about a segment of the seam;

a hole located in the block between the top of the block and the groove; and a locking device locatable in the hole, wherein initially locating the locking device into the hole causes the locking device to be juxtaposed between a portion of the first side edge of the seam of the metal roof and a portion of the first interior side wall of the block, and wherein further translocation of the locking device into the hole causes the locking device to engage the portion of the first side edge of the seam of the metal roof and the portion of the first interior side wall of the block, thereby deforming the first side edge of the seam about a portion of the locking device, securing the block to the metal roof.

2. The device of claim 1, wherein the locking device is tapered along its longitudinal axis.

3. The device of claim 2, wherein the locking device is a conical structure.

4. The device of claim 2, wherein the locking device is a wedge-shaped structure.

5. The device of claim 1, the device further comprising a cavity located along the portion of the first interior side wall of the block to accommodate a portion of the locking device.

6. The device of claim 1, wherein the further translocation of the locking device into the hole also causes the portion of the second side edge of the seam of the metal roof to incline towards the second interior side wall, the device further comprising a cavity located along a portion of the second interior side wall of the block to accommodate the portion of the second side edge of the seam of the metal roof inclined theretowards.

7. The device of claim 1, wherein the locking device comprises a rigid material.

8. The device of claim 1, wherein the locking device comprises a compressible material.

9. A device capable of securing a snow guard to a metal roof having a first roofing panel and a second roofing panel, the first and second roofing panels each having a substantially perpendicular longitudinal edge thereon, the longitudinal edge of the first roofing panel positioned in close proximity to the longitudinal edge of the second roofing panel forming a seam therealong, the seam having a top edge, a first side edge and a second side edge, the device comprising:

a block having a first and a second exterior side wall, a base and a top exterior surface, wherein the snow guard is capable of being attached to the block;

a groove located in the base of the block, the groove defining a first interior side wall, a top interior surface and a second interior side wall located on the opposite side of the first exterior side wall, top exterior surface and second exterior side wall, respectively, wherein the block is locatable on the metal roof by placement of the groove about a segment of the seam;

a hole located in the block between the first exterior side wall of the block and the groove; and a locking device locatable in the hole, wherein initially locating the locking device into the hole causes the locking device to be juxtaposed between a portion of the top edge of the seam of the metal roof and the top interior surface of the block, and wherein further translocation of the locking device into the hole causes the portion of the top edge of the seam of the metal roof to be compressed towards the base of the block, causing the locking device to be secured in the resulting compression, thereby preventing longitudinal movement of the block along the seam of the roof.

10. The device of claim 9, the device further comprising a filler block secured to an interior side wall of the block below the hole, the filler block to prevent substantial vertical movement of the block, relative to the roofing panels.

11. The device of claim 9, wherein the groove is wider near the top interior surface, relative to the width of the groove near the base of the block, and wherein the block is locatable on the metal roof by sliding the block over a terminal end of the seam.

12. The device of claim 9, wherein the locking device is tapered along its longitudinal axis.

13. The device of claim 12, wherein the locking device is a conical structure.

14. The device of claim 12, wherein the locking device is a wedge-shaped structure.

15. The device of claim 9, wherein the locking device comprises a rigid material.

16. The device of claim 9, wherein the locking device comprises a compressible material.

17. A device capable of securing a snow guard to a roof, the device comprising:

a mounting bracket comprising a first and a second plate, the first plate having a base and a top, wherein the base of the first plate is capable of being secured to the roof, the second plate having a first and a second edge and a first and a second side, wherein the first edge is securely attached to the top of the first plate and substantially perpendicular thereto;

a block having a first and a second exterior side wall, a base and a top, wherein the snow guard is capable of being attached to the block;

a groove located in the base of the block, the groove defining a first and a second interior side wall, wherein the block is locatable on the roof by placement of the groove about the second plate of the mounting bracket;

a hole located in the block between the top of the block and the groove; and a locking device locatable in the hole, wherein initially locating the locking device into the hole causes the locking device to be juxtaposed between a portion of the first side of the second plate and a portion of the first interior side wall of the block, and wherein further translocation of the locking device into the hole causes the locking device to be secured between the portion of the first side of the second plate of the mounting bracket and the portion of the first interior side wall of the block, thereby securing the block to the mounting bracket.

18. The device of claim 17, wherein the locking device is tapered along its longitudinal axis.

19. The device of claim 18, wherein the locking device is a conical structure.

20. The device of claim 18, wherein the locking device is a wedge-shaped structure.

21. The device of claim 17, the device further comprising a cavity located along the portion of the first side of the second plate of the mounting bracket to accommodate a portion of the locking device.

22. The device of claim 17, the device further comprising a cavity located along a portion of the first interior side wall of the block to accommodate a portion of the locking device.

23. The device of claim 17, wherein the locking device comprises a rigid material.

24. The device of claim 17, wherein the locking device comprises a compressible material.

25. A device capable of securing a snow guard to a roof, the device comprising:

a mounting bracket comprising a first and a second plate, the first plate having a base and a top, wherein the base of the first plate is capable of being secured to the roof, the second plate having a first edge and a second edge, wherein the first edge is securely attached to the top of the first plate and substantially perpendicular thereto;

a block having a first and a second exterior side wall, a base and a top exterior surface, wherein the snow guard is capable of being attached to the block;

a groove located in the base of the block, the groove defining a first interior side wall, a top interior surface and a second interior side wall, located on the opposite side of the first exterior side wall, top exterior surface and second exterior side wall, respectively, wherein the block is locatable on the roof by placement of the groove about the second plate of the mounting bracket;

a hole located in the block between the first exterior side wall of the block and the groove;

a first cavity located along the second edge of the second plate of the mounting bracket; and a locking device locatable in the hole, wherein locating the locking device into the hole causes the locking device to be in juxtaposition with a portion of the top interior surface of the block and located within the first cavity of the second plate of the mounting bracket, thereby preventing longitudinal movement of the block relative to the mounting bracket.

26. The device of claim 25, wherein the mounting bracket further comprises a third plate having a base and a top, wherein the base of the third plate is securely attached to the second edge of the second plate, and wherein the device further comprises a filler block secured to an interior side wall of the block below the hole, the filler block and third plate of the mounting bracket positioned to prevent substantial vertical movement of the block, relative to the roofing panels.

27. The device of claim 25, wherein the mounting bracket further comprises a third plate having a base and a top, wherein the base of the third plate is securely attached to the second edge of the second plate, and wherein the groove is wider near the top interior surface, relative to the width of the groove near the base of the block, and wherein the block is locatable on the mounting bracket by sliding the block over a terminal end of the second and third plate of the mounting bracket.

28. The device of claim 25, wherein the locking device is tapered along its longitudinal axis.

29. The device of claim 28, wherein the locking device is a conical structure.

30. The device of claim 28, wherein the locking device is a wedge-shaped structure.

31. The device of claim 25, the device further comprising a second cavity located within the second interior side wall of the block to accommodate a portion of the locking device.

32. The device of claim 25, the device further comprising a second cavity located along the top interior surface of the block to accommodate a portion of the locking device.

33. The device of claim 25, wherein the locking device comprises a rigid material.

34. The device of claim 25, wherein the locking device comprises a compressible material.

35. A device capable of securing a mechanism to a structure having a projection, the device comprising:

a block having an exterior surface and a base, wherein the mechanism is capable of being attached to the block;

a first cavity located in the base of the block, the first cavity defining an interior surface, wherein the block is locatable on the structure by placement of the first cavity about at least a portion of the projection;

a hole located in the block between the exterior surface of the block and the first cavity; and a locking device locatable in the hole, wherein initially locating the locking device into the hole causes the locking device to be juxtaposed between a portion of the projection of the structure and a portion of the interior surface of the block, and wherein further translocation of the locking device into the hole causes the locking device to be secured between the portion of the projection and the portion of the interior surface of the block, thereby securing the block to the projection.

36. The device of claim 35, wherein the locking device is tapered along its longitudinal axis.

37. The device of claim 36, wherein the locking device is a conical structure.

38. The device of claim 36, wherein the locking device is a wedge-shaped structure.

39. The device of claim 35, the device further comprising a second cavity located within the interior surface of the block to accommodate a portion of the locking device.

40. The device of claim 35, wherein the locking device comprises a rigid material.

41. The device of claim 35, wherein the locking device comprises a compressible material.

* * * * *